US006263770B1

(12) United States Patent
Gomas et al.

(10) Patent No.: US 6,263,770 B1
(45) Date of Patent: Jul. 24, 2001

(54) TOOL COMPRISING A DAMPING AND/OR OPENING SPRING

(75) Inventors: Maurice Hervé Gilbert Gomas, Saint Fargeau; Franck Vejux, Ecole Valentin, both of (FR)

(73) Assignee: Bost Garnache Industries, Arbois (FR)

( * ) Notice: Subject to any disclaimer, the term of this patent is extended or adjusted under 35 U.S.C. 154(b) by 0 days.

(21) Appl. No.: 09/257,379

(22) Filed: Feb. 25, 1999

(30) Foreign Application Priority Data

Feb. 27, 1998 (FR) ..... 98 02436

(51) Int. Cl.[7] ..... B25B 7/02
(52) U.S. Cl. ..... 81/427
(58) Field of Search ..... 81/417, 427, 427.5

(56) References Cited

U.S. PATENT DOCUMENTS 3,458,933 * 8/1969 Rogers ..... 81/417
3,583,264 * 6/1971 Brunosson et al. ..... 81/415
3,921,478 * 11/1975 Ygfors ..... 81/417
4,304,158 * 12/1981 Brunosson et al. ..... 81/417
5,522,289 * 6/1996 Eggert ..... 81/417
5,522,290 * 6/1996 Visser et al. ..... 81/427
5,603,643 * 2/1997 Krivec ..... 439/822

FOREIGN PATENT DOCUMENTS 1443913 7/1976 (GB) .

* cited by examiner

*Primary Examiner*—Joseph J. Hail, III
*Assistant Examiner*—David B. Thomas

(57) ABSTRACT

A tool having relatively movable working elements which are movable with respect to one another by relative movement of a pair of arms or handles wherein a spring element formed from a material consisting of a flexible polymer or elastomer is secured intermediate the arms to thereby provide a damping force opposing selectively movement of the arms toward one another.

19 Claims, 5 Drawing Sheets

TOOL COMPRISING A DAMPING AND/OR OPENING SPRING

BACKGROUND OF THE INVENTION

1. Field of the Invention

The present invention relates to a tool, of the type comprising an arm or handle which has a metal part and which, when the tool is used, is brought closer to an element opposite, particularly consisting of a base or of another arm or handle of the tool, and a damping and/or opening spring.

2. Discussion of the Related Art

The invention applies particularly to the various types of pliers (flat-nose or round-nose pliers, so-called combination pliers, side cutters, etc.), to secateurs and to tools comprising a relatively long arm or lever articulated by one end to a base, such as shears, guillotines, ricers, etc.

SUMMARY OF THE INVENTION

The object of the invention is to provide a damping and/or opening spring which, although particularly economical, can be passed on in varying forms suited to predetermined behaviour during use of the tool, and which can also act as a member for positioning and/or limiting the extent of opening of the arm with respect to the element opposite.

To this end, the subject of the invention is a tool of the aforementioned type, characterized in that the spring comprises a spring-forming part based on flexible polymer or elastomer, which flexes and/or compresses as the said arm is brought closer, and the ends of which are secured respectively to the arm and to the element opposite.

DESCRIPTION OF THE DRAWINGS

Exemplary embodiments of the invention will now be described with reference to the appended drawings, in which.

DESCRIPTION OF THE PREFERRED EMBODIMENTS

Figure 1:
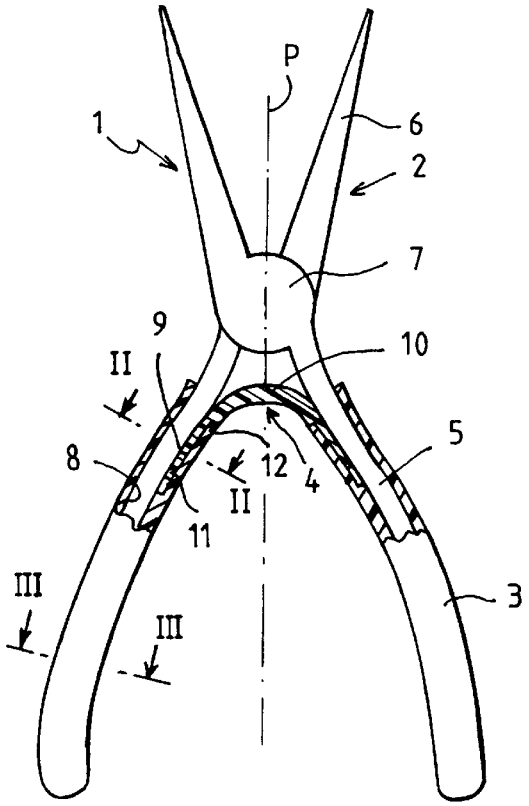
FIG. 1 is a view, in part section, of a pair of flat-nose pliers in accordance with the invention.

FIG. 1 depicts a pair of flat-nose pliers 1 consisting of two metal limbs 2, two sheaths 3 and a spring 4.

Each metal limb 2 defines a handle arm 5 and a flat nose 6, the two limbs 2 being articulated to one another in the manner of a pair of scissors in an intermediate region or joint 7, in the conventional way, by means of a rivet or the like, not depicted.

Each sheath 3 is a molded plastic component which, starting from its distal end, exhibits a blind passage 8 which fits snugly over a handle arm 5.

Figure 2:
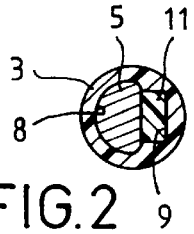
FIGS. 2 and 3 are views in section, respectively, along lines II—II and III—III of FIG. 1.
Figure 3:
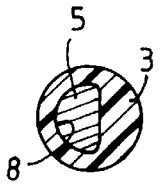

As can be seen in FIGS. 1 and 2, over a limited length from its distal end, each passage 8 is enlarged towards the mid-plane P of the pliers, that is to say towards the other handle, by a lateral gusset 9 of rectangular cross section.

In the example depicted, the passage 8 has a more or less semicircular cross section and the diameter of the semicircle forms a long side of the rectangular cross section of its gusset 9.

Figure 14:
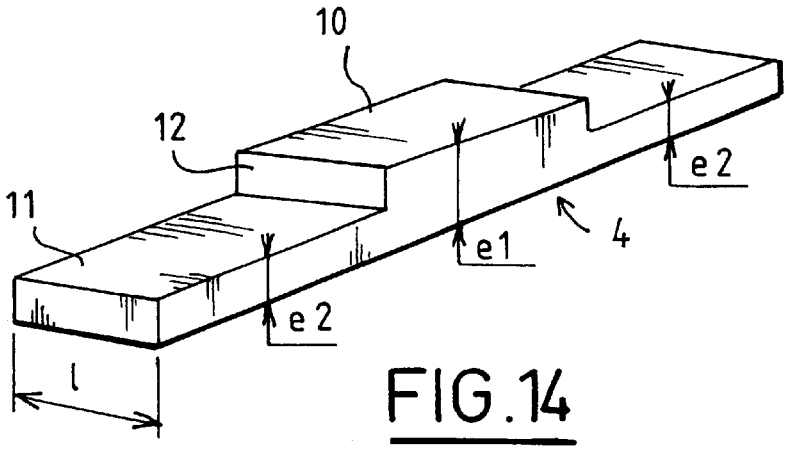
FIG. 14 depicts in perspective the spring for the pliers of FIGS. 1 and 4.

The spring 4 is depicted in perspective in FIG. 14.

It consists of a strip of thermoplastic, for example polyacetal, or of vulcanized or thermoplastic elastomer. This strip has a rectangular cross section of constant width l, with a central region 10 whose thickness e1 is greater than the thickness e2 of each end part 11.

When the spring is in the as-fitted condition, each part 11, which forms a part for attaching the spring, fits with a small amount of clearance into a gusset 9, the part 10 facing away from the joint 7.

Thus each part 11 is in contact, on the one hand, with the inner face of the arm 5 and, on the other hand, with the three walls of the gusset 9, and it is pushed into this gusset until the shoulder 12 which separates it from the central part 10 presses on the mouth of the gusset.

Thus, at rest, the spring 4 tends to resume its original planar configuration, and therefore urges the two arms 5 towards their wide open position, or even as far as this position, as depicted in FIG. 1.

When the user brings the arms 5 closer together, he causes the thick part 10 to bend against its elastic straightening force.

It will be understood that the stiffness of the spring 4 can be adjusted through the choice of length and thickness of the spring-forming part 10.

Furthermore, the spring 4, being made of an insulating material and forming a bridge between the sheaths 3 which are themselves insulating, provides the user's fingers with good protection against electric shock.

Figure 4:
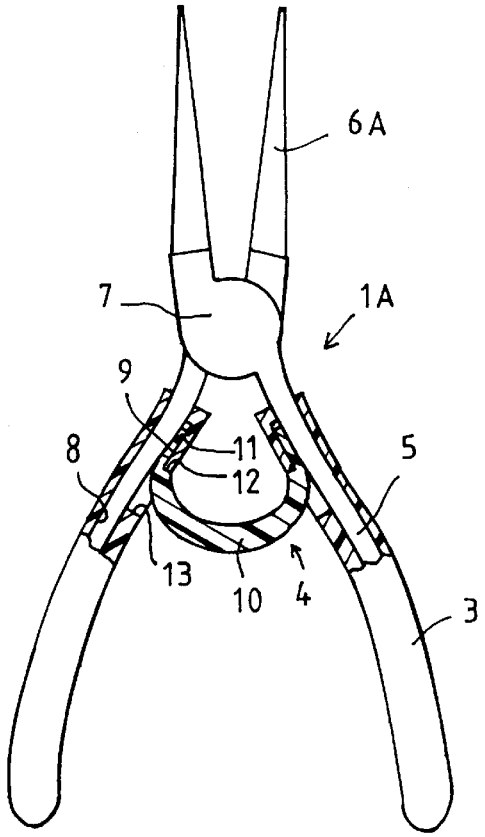
FIG. 4 is a view similar to FIG. 1 of a pair of round-nose pliers constituting an alternative form.

In the alternative form of FIG. 4, applied to a pair 1A of round-nose 6A pliers, the blind gussets 9 start from a point some way along the sheath 3, which at this point has an internal lateral opening 13, and they extend towards the distal end of the sheath, as far as a short distance from this end.

As an alternative, the gussets 9 may also open onto the distal end of the sheath.

The spring 4 is the same as before, but its central part 10 has an increase in thickness towards the joint 7. Consequently, each attachment part 11 is introduced into the associated gusset 9 until the shoulder 12 presses against the distal edge of the opening 13.

As before, bringing the arms 5 closer together stresses the spring 4 in bending, and this spring tends to straighten itself and return the pliers to or towards their wide open position of FIG. 4.

Figure 5:
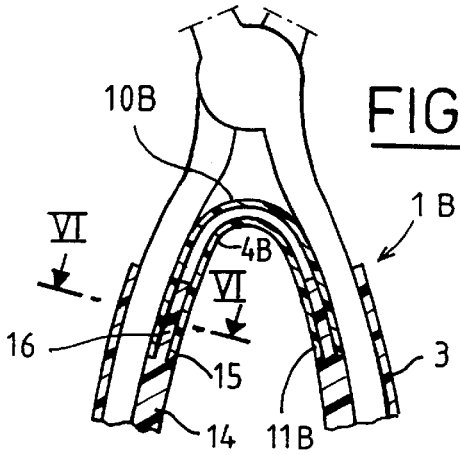
FIG. 5 is a partial view with part section of another embodiment.
Figure 6:
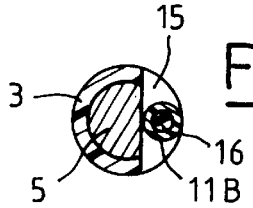
FIG. 6 is a view in section along line VI—VI of FIG. 5.

In the example 1B of FIGS. 5 and 6, the sheath 3 has on its inside an increase in thickness 14 which ends in a shoulder 15 a certain distance from the distal end of the sheath. Projecting from this shoulder is a cylindrical stud 16. The spring 4B is a tube made of flexible plastic, for example of circular cross section, the end parts 11B of which fit with a small amount of clearance onto the stud 16 until they press against the shoulder.

The tube is then externally in contact with the arm 5. Its central spring-forming part 10B has, as was the case in FIG. 1, a bowed shape with the concave side away from the joint 7, and it tends to straighten itself, thereby opening the pliers.

The alternative form 1C in FIGS. 7 and 8 differs from the previous one in the following two respects.

On the one hand, the stud 16 projects towards the proximal end of the sheath, in an inside lateral recess 17 thereof, the shoulder 15 being defined on a distal end part 18 of this sheath.

On the other hand, the spring-forming central part 10C of the spring 4C has the shape of a solid rod, while the two end parts 11C, of the same external cross section, are tubular and fit as before onto the studs 16 until they press on the shoulders 15.

Figure 7:
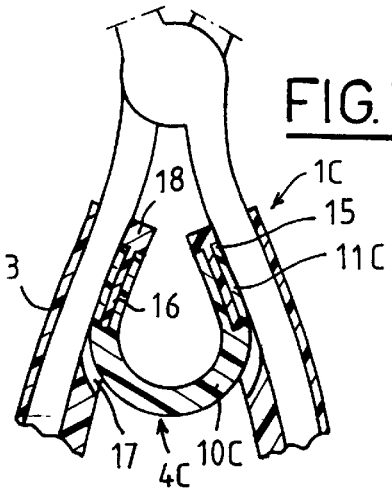
FIG. 7 is a view similar to FIG. 5 of an alternative form.
Figure 8:
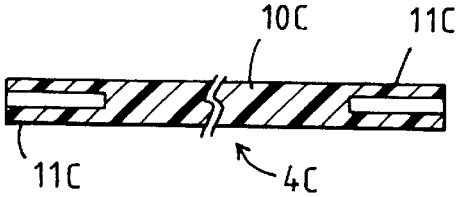
FIG. 8 depicts, in longitudinal section, the spring for the pliers of FIG. 7.

Choosing a tubular 4B or partially tubular 4C spring, in each of the configurations of FIGS. 5 and 7, makes it possible to define the stiffness of the spring.

Figure 9:
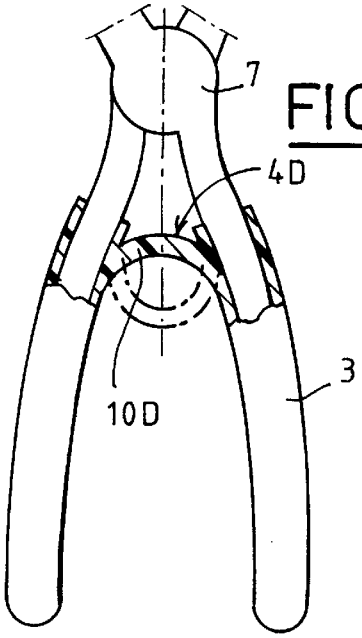
FIG. 9 is a view similar to FIG. 5 of another embodiment.
Figure 10:
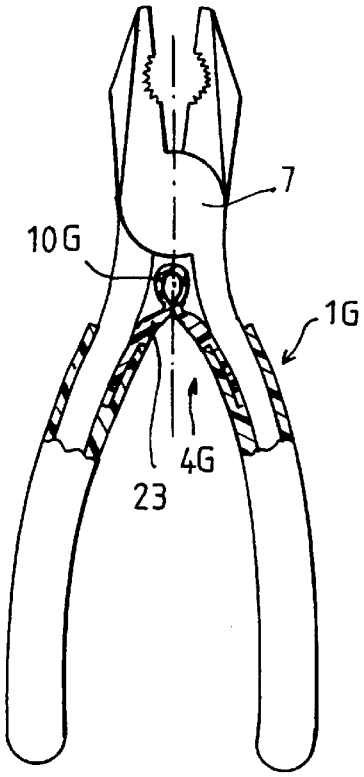
FIG. 10 is a view similar to FIG. 1 of a pair of combination pliers in another embodiment of the invention.
Figure 11:
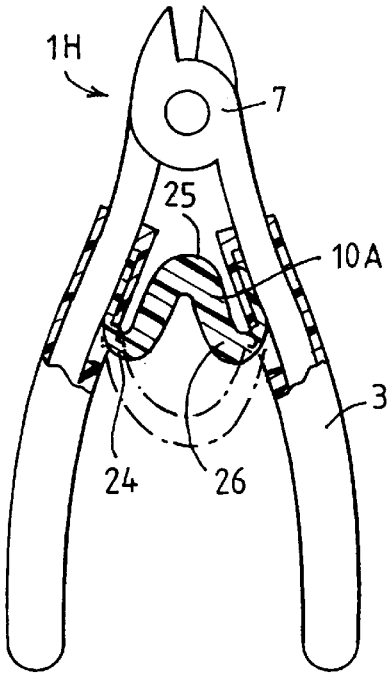
FIG. 11 is a view similar to FIG. 1 of a pair of side cutters according to another embodiment of the invention.

FIGS. 9 to 11 illustrate three other embodiments of the invention.

In the case of FIG. 9, the spring-forming part 10B of the spring 4D is a bow, the concave side of which faces away from the joint 7 and which is moulded integrally with the two sheaths 3.

As an alternative, the concave side could, of course, face the joint, as depicted in chain line.

Figure 12:
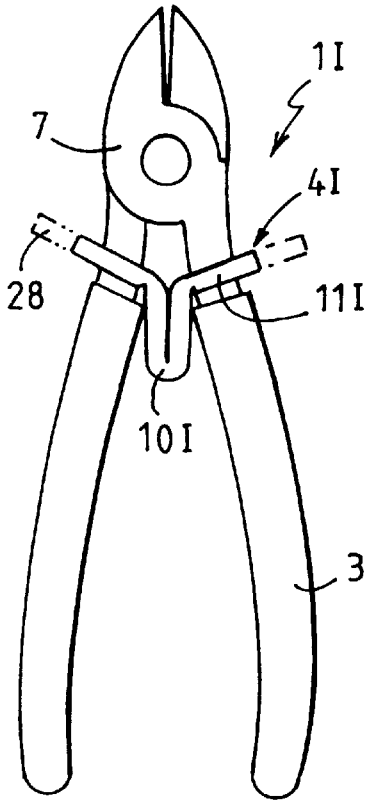
FIG. 12 depicts another pair of side cutters according to the invention.

The examples of FIGS. 10 to 12 make it possible to obtain at least two different spring stiffnesses while the two arms 5 are being brought closer together.

In the pliers 1G of FIG. 10, which are depicted as combination pliers, the spring 4G differs from the spring 4 in FIG. 1 in that its intermediate part 10G is in the shape of a Ω and extends right up close to the joint 7.

Consequently, as the arms 5 start to be brought closer together, the two lower or proximal legs 23 of the Ω are straightened out downwards, which causes a relatively weak initial elastic effect. Next, the top of the Ω comes into contact against the joint 7, and continuing to bring the arms 5 closer together not only continues to straighten out the legs of the Ω but also begins to flatten its loop. The spring stiffness is thus increased.

In the embodiment of FIG. 11, applied to side cutters 1H, use is made of the spring 4A of FIG. 4, deformed by pushing its central part 10A towards the joint 7, which gives the spring a W shape.

As the two arms 5 start to be brought closer together, the spring therefore experiences threefold bending, at the points 24 to 26, which provides a first stiffness, greater than that of the spring 4A of FIG. 4. Next, the central part 10A is trapped, folded, between the inner faces of the two sheaths 3, just before the pliers are fully closed. Closure is therefore completed while at the same time compressing the plastic elastomer on itself, which produces distinctly stronger elastic resistance.

The effect thus obtained is one of damping the final manual effort, which avoids the user feeling a jolt in his hand when cutting through a metal wire or the like.

As depicted in chain line in FIG. 11, it is possible to envisage using the same spring 4A in the W configuration and in the simply bowed shape of FIG. 4, either in different pairs of pliers or in the same pair of pliers. The user can therefore choose a single stiffness or two successive stiffnesses for each use of the pliers.

As an alternative, one or all of the curvatures of the spring may be reversed, like in FIG. 1, it then being possible for the spring to adopt an M shape.

Also an alternative, if, in the W- or M-shaped configuration, the central part 10A is not trapped at the end of closure, the user may simply choose between a low stiffness (bowed shape) and a greater stiffness (W or M shape).

Figure 13:
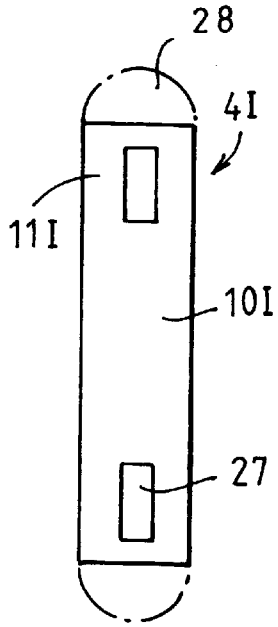
FIG. 13 depicts the spring for the pliers of FIG. 12.

A similar effect of two successive stiffnesses is achieved using the side cutters 1I of FIG. 12, in which the spring 4I depicted alone in FIG. 13, is a strip of plastic or elastomer which close to each end has an aperture 27 which fits over an arm 5 and is placed just before the distal end of the sheath 3. The spring thus has the overall shape of a pair of spectacles. The central part 10I is bent into a V.

During the first part of the travel of bringing the arms 5 closer together, the part 10I is stressed in bending, which produces relatively weak elastic resistance.

Shortly before the fully closed position, as depicted in FIG. 12, the part 10I, completely folded, is trapped between the distal ends of the two sheaths 3, and this causes the material of the spring to be compressed onto itself and produces greater elastic resistance.

As an alternative, as shown in chain line in FIGS. 12 and 13, the end parts 11I of the spring 10I may be extended to form external guards 28 for the user's fingers. In this case, the parts 11I may be curved and shaped to fit in with the appearance of the distal part of the sheaths 3.

Figure 15:
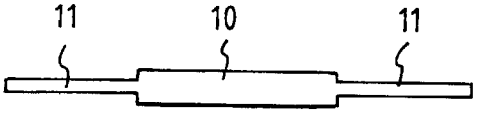
FIGS. 15 to 20 depict various profiles forming alternative versions of the spring of FIG. 16.
Figure 18:
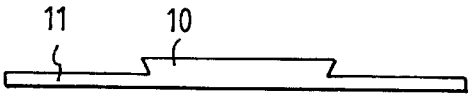
Figure 16:
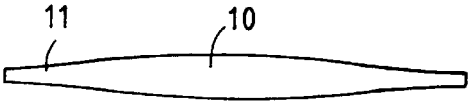
Figure 19:
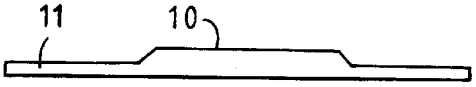
Figure 17:
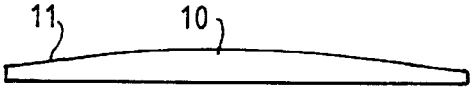
Figure 20:
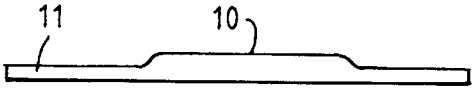
Figure 21:
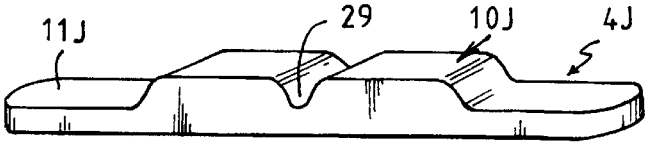
FIG. 21 is a perspective view of yet another spring according to the invention.
Figure 22:
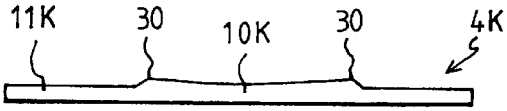
FIG. 22 depicts the profile of another embodiment of the spring in accordance with the invention.

FIGS. 15 to 22 depict, in side view, the profiles of various springs which can be fitted to the pliers 1 or 1A of FIGS. 1 and 4:

FIG. 15: the central part 10 has an increase in thickness on both sides of the spring;

FIGS. 16 and 17: the central part 10 is domed and meets the attachment parts 11 with a continuous curvature, without forming a shoulder. The increase in thickness may be on both sides (FIG. 16) or on just one side (FIG. 17);

FIGS. 18 to 20: the central part 10 is connected to the end parts 11 by undercut shoulders (FIG. 18), or alternatively sloping shoulders (FIG. 19), or alternatively by two rounded portions (FIG. 20);

FIG. 21: the central part 10J of the spring 4J has a cutout 29 mid-way along its length, so that beginning to fold this part 10J provides relatively weak elastic resistance then, when the flanks of the cutout 29 come into mutual contact, the elastic resistance is markedly increased;

FIG. 22: the central part 10K of the spring 4K has a greater thickness at its two ends 30 than at any intermediate point. Consequently, as the arms 5 are brought closer together, there is first of all a simple bending of the part 10 (relatively weak elastic resistance), then, when the ends 30 come into mutual contact, there is compression of the material of the spring (markedly greater elastic resistance).

In alternative forms which have not been depicted, the spring-forming part can be over molded onto one or both attachment parts made of some other material, particularly a metallic one.

What is claimed is:

1. A tool comprising two elongate members pivoted together to thereby define opposing and relatively movable working elements and arms which are movable relatively closer to one another by a first distance to move said working elements relative to one another, each arm having an outer end and a base portion spaced from said outer end, a damping spring element mounted between said arms, said spring element including a flexible material selected from a group of materials consisting of polymers and elastomers, said flexible material having a first elastic resistance to movement of said arms relative to one another along a first portion of said first distance and a second greater resistance to movement of said arms relative to one another along a second portion of said first distance.

2. Tool according to claim 1 wherein said spring element has a central portion from which extends opposite relatively movable segments, said spring element being configured to bend at said central portion as said arms are moved relatively to one another along said first portion of said first distance and such that said opposite relatively movable segments engage one another as said arms are moved relative to one another along said second portion of said first distance.

3. Tool according to claim 2 wherein a thickness of the spring element is greater at said outer relatively movable segments than at any other point along a length thereof.

4. Tool according to claim 1 wherein the spring element has a cutout located at a central portion thereof.

5. Tool according to claim 2 wherein said spring element is mounted to said arms so that said central portion thereof engages at least one of said arms adjacent a pivot point between said elongate members as said arms are moved relative to one another along said first distance.

6. Tool according to claim 2 wherein the spring element is selected from a group of shapes consisting of "W" and an "M".

7. Tool according to claim 2 wherein the spring element is bowed.

8. Tool according to claim 2 wherein said spring element includes opposite ends extending from said opposite relatively movable segments, and means for securing said ends to said arms at said base portions thereof.

9. Tool according to claim 8, wherein the spring element is integrally formed.

10. Tool according to claim 8, wherein said means for securing includes said opposite ends of said spring element being formed integrally with sheath members secured over said arms.

11. Tool according to claim 8, wherein said opposite ends are not as thick as said movable segments, said means for securing includes a sheath fitted over each arm, and said opposite ends of said spring element being seated within gussets formed in each sheath.

12. Tool according to claim 8, wherein said means for securing includes each of said opposite ends of said spring element including a ring portion designed to grip around an adjacent arm.

13. Tool according to claim 12, wherein the spring element is in the overall shape of a pair of spectacles.

14. Tool according to claim 12, wherein said opposite ends extend from said arms to form external guards for a user's fingers.

15. Tool according to claim 8, wherein said means for securing includes said opposite ends being tubular and of a size to engage about a stud secured to each of said arms.

16. Tool according to claim 15, wherein the spring element is tubular.

17. A tool comprising two elongated members which are pivotally secured to one another to thereby define opposing and relative movable working elements and arms which are relatively movable toward and away from one another, a damping spring element including a flexible material formed from a group of materials consisting of polymers and elastomers, said spring element including a central portion and outwardly extending relatively movable segments extending from said central portion, said spring element including opposite ends extending from said relatively movable segments and said opposite ends being integrally formed with sheathes which are mounted about said arms.

18. A tool comprising two elongated members which are pivotally secured to one another to thereby define oppositely and relatively movable working elements and arms which are relatively movable toward and away from one another, a damping spring element including a flexible material formed from a group of materials consisting of polymers and elastomers, said spring element including a central portion and outwardly extending relatively movable segments extending from said central portion, sheath elements mounted about each of said arms, a gusset formed in each of said sheath elements, said spring element including outer ends extending from said relatively movable segments which are mounted within said gussets, and said outer ends of said spring element being of reduced thickness with respect to said relatively movable segments.

19. The tool of claim 1 wherein said damping spring element is configured to bend as said arms are moved along said first portion of said first distance and thereafter being compressed as said arms are moved along said second portion of said first distance.

* * * * *